US005709597A

United States Patent [19]

Sarantitis

[11] Patent Number: 5,709,597

[45] Date of Patent: Jan. 20, 1998

[54] PIVOTAL VACUUM SHIELD FOR AN ABRADING DEVICE

[76] Inventor: Andreas I. Sarantitis, 327 Lilac La., Carlstdt, N.J. 07072

[21] Appl. No.: 561,427

[22] Filed: Nov. 21, 1995

[51] Int. Cl.[6] ..... B24B 55/06

[52] U.S. Cl. ..... 451/456; 451/451; 451/353

[58] Field of Search ..... 451/451, 456, 451/353, 354, 359, 455, 453, 454, 87

[56] References Cited

U.S. PATENT DOCUMENTS

| | | | |
|---|---|---|---|
| 3,458,885 | 8/1969 | Danielsson | 451/353 |
| 3,826,045 | 7/1974 | Champayne | 451/456 |
| 3,987,589 | 10/1976 | Marton | 451/456 |
| 4,328,645 | 5/1982 | Sauer | 451/456 |
| 4,719,659 | 1/1988 | Urakami | 451/353 |
| 4,765,099 | 8/1988 | Tanner | 451/456 |
| 4,986,703 | 1/1991 | Hampl et al. | 451/456 |
| 5,125,190 | 6/1992 | Buser et al. | 451/456 |
| 5,239,783 | 8/1993 | Matechuk | 451/456 |

*Primary Examiner*—James G. Smith
*Assistant Examiner*—Dona C. Edwards
*Attorney, Agent, or Firm*—M. K. Silverman

[57] ABSTRACT

A vacuum shield for an abrading device adapted for use upon non-uniform surfaces. The shield includes a general planar top housing mountable between a motor of the abrading device, such as a power stripper or sander, and its abrading element there. The housing includes at least an upper, a middle, and a lower surface, the middle surface including a first opening, through which a power shaft between the motor and the abrading element can pass. Each of the upper and lower surfaces are secured upon a separate downwardly-biased pivot axis to respectively opposite sides of the middle surface, for angular movement relative to an axis defined by the power shaft. The middle surface also includes a second opening for connection to a vacuum hose coupling. The shield further includes continuous flexible skirts depending from the entire length of opposite non-hinged edges of the middle segment. Each of the upper and lower surfaces of the top housing also include continuous flexible skirts which depend from the entire length of each on the non-hinged edges. The combination of the flexible skirts of the upper, middle and lower surfaces function to mechanically and pneumatically surround the abrading element Irregularities in any non-uniform surface to be abraded will be substantially conformed to, and otherwise enveloped by, the function of the flexible skirts and of the pivotally downwardly biased relationship of the upper and lower surfaces to the middle surface of the top housing.

11 Claims, 1 Drawing Sheet

PIVOTAL VACUUM SHIELD FOR AN ABRADING DEVICE

BACKGROUND OF THE INVENTION

The present invention relates to a vacuum shield for use with abrading devices such as power stripping and sanding machines. More particularly, the instant invention relates to a system for the containment of particles resultant of the operation of abrading devices upon non-uniform surfaces.

A long-standing problem in the prior art of vacuum means associated with devices such as power strippers and power sanders has been that the available vacuum shield means associated therewith are effective only when the abrading operation occurs with reference to a uniform or substantially uniform, i.e., flat surface. More particularly, the approach of the prior art as, for example, is reflected in U.S. Pat. No. 4,622,782 (1986) to Roestenberg and German Patent No. 2,539,762 (1977) has been that of providing sander shields that can be pivoted upwardly and, thereby, out of vacuum or pneumatic communication with the abrading region to permit the abrading elements to reach non-uniform parts of a surface to be abraded. In other words, the approach of the prior art to containment during abrading operations, when it is necessary to abrade a non-uniform part of a given work surface, is to simply remove a portion of the vacuum shield from the abrading area. This approach of course renders such a shield completely ineffective when the shield is lifted out of the work area.

It is, accordingly, to be appreciated that there has long existed a need for a vacuum shield for power strippers, power sanders and the like, which is effective to contain and remove particles resultant from the abrading operation even as the abrading device is used upon irregular or uneven surface geometries. The present invention may therefore be viewed as a response to this long-felt need in the art.

SUMMARY OF THE INVENTION

The present invention is a system for the removal of particles resultant of the operation of an abrading device upon a non-uniform surface. The system more particularly comprises a general planar top housing mountable between a motor of the abrading device (such as a power stripper or sander) and the abrading element thereof. Said housing includes at least an upper, a middle, and a lower surface, said middle surface including a first opening therein, through which a power shaft between said motor and said abrading element can pass. Each of said upper and lower surfaces secured upon a separate downwardly-biased pivot axis to respectively opposite sides of said middle surface, for angular movement relative to an axis defined by said power shaft. Said middle surface also includes a second opening for connection to a vacuum hose coupling and for providing pneumatic communication to a region of operation of said abrading element between said housing and said non-uniform surface. The system further includes continuous flexible skirts depending from the entire length of opposite non-hinged edges of said middle segment. Further, each of said upper and lower surfaces of said planar top housing include continuous flexible skirts which depend from the entire length of each on the non-hinged edges thereof. The combination of said flexible skirts of said upper, middle and lower surfaces function to mechanically and pneumatically surround said abrading element and the work device. Thereby, irregularities in said non-uniform surface to be abraded will be substantially conformed to, and otherwise enveloped by, the function of said flexible skirts and of the pivotally downwardly biased relationship of said upper and lower surfaces to said middle surface of said planer top housing.

It is, accordingly, an object of the present invention to provide a mechanical and vacuum shield for an abrading machine which will facilitate the containment and removal of particles resultant from abrading operations upon a surface of non-uniform texture or geometry.

It is another object to provide a mechanical and vacuum shield for an abrading device which will preclude the escape of dust and other abrasion-related debris without regard to the uniformity or flatness of the work surface.

It a further object of the invention to provide a system of the above type in which a coupling of a vacuum hose to the housing about the abrading element will not interfere with normal operation of the abrading device.

The above and yet other advantages of the present invention will become apparent from the hereinafter set forth Brief Description of the Drawings, Detailed Description of the Invention, and Claims appended herewith.

DETAILED DESCRIPTION OF THE INVENTION

Figure 1:
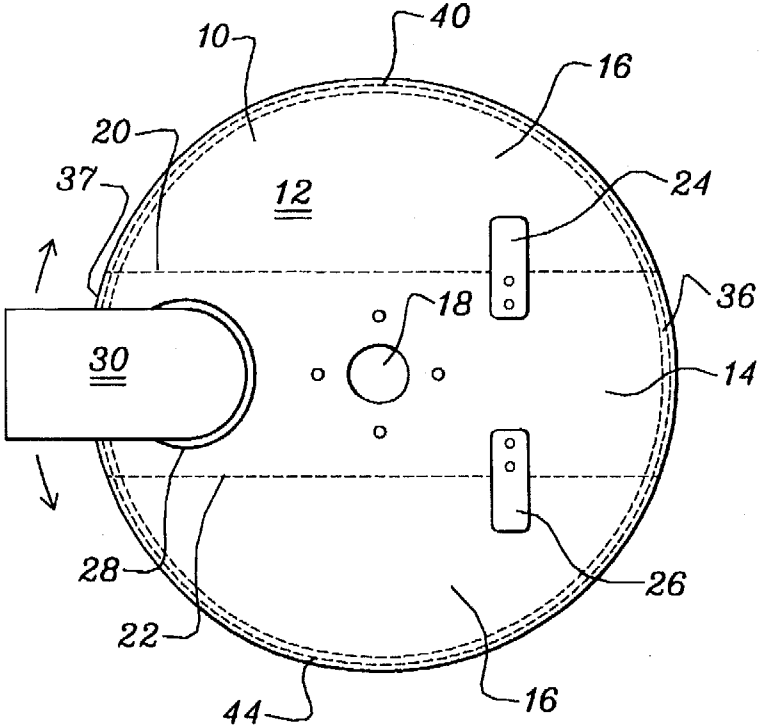
FIG. 1 is a top plan view of the inventive system.

With reference to the top view of FIG. 1, the present inventive vacuum shield may be seen to include a general planar rigid top housing 10 which is mountable between a motor (not shown) of an abrading device such as a stripping or sanding means, and the abrading element thereof (not shown).

With reference to FIG. 1, it may be noted that said top housing 10 includes at least an upper surface 12, a middle surface 14 and a lower surface 16. Said middle surface includes a first opening 18 thru which a power shaft (not shown) provides mechanical communication between said motor and said abrading element and is able to pass. It is, thereby, to be appreciated that in the same fashion as is shown in the prior art, e.g., said patent to Roestenberg, referenced in the Background of the Invention, the inventive vacuum shield is secured about the power shaft of the abrading device, intermediate between the abrading element and the motor thereof.

With further reference to FIG. 1, it should be noted that each of said upper and lower surfaces 12 and 16 respectively are secured, by respective pivot axes 20 and 22 to said middle surface 14. It is to be further noted that each of said pivot axes 20 and 22 are downwardly (with reference to the plane of FIG. 1) biased through the use of biasing means 24 and 26 respectively. It is to be understood that said biasing means may assume a variety of different forms which, in addition to the illustrated resilient tab-like structures, may comprise spring or other resilient means which extend to all or part of the length of said axes 20 and 22. Alternatively, a plurality of the tab-like resilient biasing means 24 and 26 may be used upon the respective pivot axes 20 and 22.

With yet further reference to FIG. 1, it should be noted that said middle surface 14 also includes a second opening which is used for connection to a vacuum hose coupling 30 which in turn connects to a vacuum hose (not shown) of a general purpose industrial vacuum cleaner to thereby assure the presence of a continuous supply of negative pressure beneath the top housing 10 of the instant system. Accordingly, coupling 30 is, at all times, in pneumatic communication with a region of operation 32 (see FIG. 2) which constitutes the region of operation of the abrading element. Accordingly, there is defined a region of negative fluid pressure between the under or lower surface of housing 10 and the work surface to be abraded.

Figure 3:
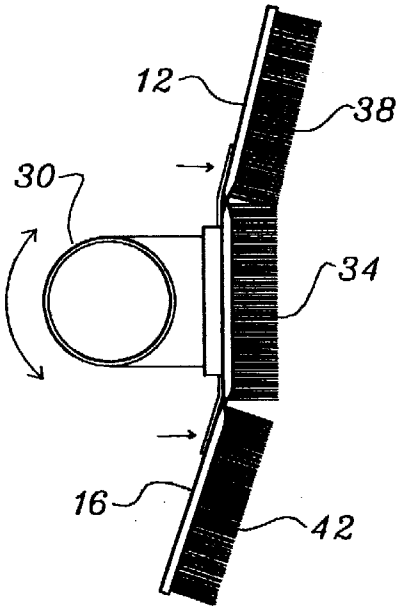
FIG. 3 is a side elevational view, similar to the view of FIG. 2, showing different respective positions of the upper and lower surfaces of the top housing relative to the middle surface thereof.
Figure 2:
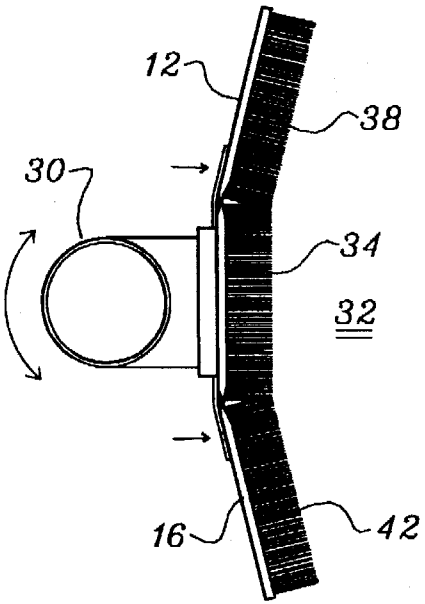
FIG. 2 is a side elevational view showing a first position of the upper and lower surfaces of the top housing of the system relative to the middle surface thereof.

As may be noted in the views of FIGS. 1 thru 3, hose coupling 30 is rotatable relative to said second opening 28 and, typically, will be rotatable to the extent of 360 degrees relative to said middle surface 14. Accordingly, the present system may be freely used in any position without regard to the direction or position of the vacuum hose to which coupling 30 is connected.

With reference to FIGS. 2 and 3, the instant system may be seen to include opposing continuous flexible skiffs 34 which depend from opposite non-hinged edges 36 and 37 (see FIG. 1) of said middle surface 14.

In the figures, it is to be further noted that there is also provided a continuous flexible skirt 38 which depends from a non-hinged edge 40 of said upper surface 12. Similarly, another continuous flexible skirt 42 depends from a non-hinged edge 44 of said lower surface 16. It is to be appreciated that when the abrading element of the abrading device is in contact with a work surface, said skirts 34, 38 and 42 will mechanically and pneumatically surround the abrading element and that part of the work surface within said skirts. Thereby, as may be noted from the views of FIGS. 2 and 3, the resilient downwardly biased function of said biasing means 24 and 26 relative to the respective pivot axes 20 and 22 will enable the system to substantially conform to any irregular or non-uniform geometry of a work surface that may be encountered. The benefit of this function is to ensure that removal of particles will occur during any abrading operation, such as stripping or sanding, against a curved, uneven or otherwise irregular surface. That is, the vacuum in the region of the work surface will not lose its integrity, as is the case in the prior art discussed above.

It is to be appreciated that said skirts 34, 38 and 42 may be formed of a variety of materials including brushes as are shown in FIG. 2 and 3. For example, a flexible elastomeric material may be employed as an equivalent of brushes or brush bristles of the type shown in the figures.

It is to be further understood that the FIGS. 2 and 3 reflect but examples of the different geometries to which the upper and lower surfaces 12 and 16 respectively may conform. That is, it is noted that the extent of bending or angulation of the upper and lower surface relative to the middle surfaces may, upon a given work surface, be much more pronounced than that which is shown in FIGS. 2 and 3.

It is noted that the present system may be formed with only one of said upper and lower surfaces 12 and 16.

Further, it is to be appreciated that second opening 28 and hose coupling 30 may, in another embodiment of the invention, be located within either upper surface 12 or lower surface 16.

While them has been shown and described the preferred embodiment of the instant invention it is to be appreciated that the invention may be embodied otherwise than is herein specifically shown and described and that, within said embodiment, certain changes may be made in the form and arrangement of the parts without departing from the underlying ideas or principles of this invention as set forth in the Claims appended herewith.

What I claim as new, useful and non-obvious and, accordingly, secure by Letters Patent of the United States is:

1. A system for the removal of particles resultant of the operation of an abrading device upon a non-uniform surface, the system comprising:

(a) a general planar top housing mountable between a motor of said abrading device and an abrading element thereof, said housing comprising at least an upper, a middle and a lower surface, said middle surface including a first opening therein, through which a power shaft providing mechanical communication between said motor and said abrading element can pass, each of said upper and lower surfaces secured, on a separate downwardly biased pivot axis to respectively opposite sides of said middle surface, for independent angular movement relative to a transverse axis defined by said power shaft, said middle surface also including a second opening for connection to a vacuum hose coupling;

(b) first and second continuous flexible skirts depending from an entire length of each opposite non-hinged edge of said middle segment;

(c) a third continuous skirt depending from an entire length of a non-hinged edge of said upper surface; and (d) a fourth continuous flexible skirt depending from an entire length of a non-hinged edge of said lower surface, a combination of all of said flexible skirts mechanically and pneumatically surrounding said abrading element of the abrading device, whereby irregularities of a work surface to be abraded will be substantially conformed to by said skirts and by a pivotally downwardly biased relationship of said respective upper and lower surfaces to said middle surface of said top housing.

2. The system as recited in claim 1, in which said skirts comprise brush means.

3. The system as recited in claim 1, in which said skirts comprise solid resilient strips.

4. The system as recited in claim 1, in which said vacuum hose coupling defines a range of motion of about 360 degrees relative to the plane of said top housing.

5. A system for the removal of particles resultant of the operation of an abrading device upon a non-uniform surface, the system comprising:

(a) a general planar top housing mountable between a motor of said abrading device and an abrading element thereof, said housing comprising at least an upper, a middle and a lower surface, said middle surface including a first opening therein, through which a power shaft providing mechanical communication between said motor and said abrading element can pass, each of said upper and lower surfaces secured, on a separate downwardly biased pivot axis to respectively opposite sides of said middle surface, for independent angular movement relative to a transverse axis defined by said power shaft, (b) first and second continuous flexible skirts depending from an entire length of each opposite non-hinged edge of said middle segment;

(c) a third continuous skirt depending from an entire length of a non-hinged edge of said upper surface; and (d) a fourth continuous flexible skirt depending from an entire length of a non-hinged edge of said lower surface, a combination of all of said flexible skirts mechanically and pneumatically surrounding said abrading element of the abrading device, whereby irregularities of a work surface to be abraded will be substantially conformed to by said skirts and by a pivotally downwardly biased relationship of said respective upper and lower surfaces to said middle surface of said top housing.

6. The system as recited in claim 5, in which said top surface includes a second opening for connection to a vacuum hose coupling.

7. The system as recited in claim 5, in which said middle surface includes a second opening for connection to a vacuum hose coupling.

8. The system as recited in claim 5, in which said lower surface includes a second opening for connection to a vacuum hose coupling.

9. A system for the removal or particles resultant of the operation of an abrading device upon a non-uniform surface, the system comprising:

(a) a general planar top housing mountable between a motor of said abrading device and an abrading element thereof, said housing comprising at least an upper, a middle surface, one of said surfaces including a first opening therein, through which a power shaft providing mechanical communication between said motor and said abrading element can pass, each of said upper surface secured, on a separate downwardly biased pivot axis to respectively opposite sides of said middle surface, for independent angular movement relative to a transverse axis defined by said power shaft, one of said surfaces also including a second opening for connection to a vacuum hose coupling;

(b) first and second continuous flexible skirts depending from an entire length of each opposite non-hinged edge of said middle segment; and (c) a third continuous skirt depending from an entire length of a non-hinged edge of said upper surface, whereby irregularities of a work surface to be abraded will be substantially conformed to by said skirts and by a pivotally downwardly biased relationship of said respective upper surface to said middle surface of said top housing.

10. The system as recited in claim 9, in which said top surface includes an opening for connection to said vacuum hose coupling.

11. The system as recited in claim 9, in which said middle surface includes a second opening for connection to said vacuum hose coupling.

* * * * *